United States Patent [19]

Hudec et al.

[11] Patent Number: 4,653,140

[45] Date of Patent: Mar. 31, 1987

[54] DOOR STOP/CLAMP DEVICE

[76] Inventors: Anthony J. Hudec; Wayne C. Hudec, both of 100 S. Herbert Rd., Riverside, Ill. 60546

[21] Appl. No.: 781,697

[22] Filed: Sep. 30, 1985

[51] Int. Cl.[4] ..... E05F 5/02; E05C 17/54

[52] U.S. Cl. ..... 16/82; 292/339

[58] Field of Search ..... 16/82, 85; 292/DIG. 15, 292/338, 339, 182

[56] References Cited

U.S. PATENT DOCUMENTS

| | | | |
|---|---|---|---|
| 771,753 | 10/1904 | Stanley | 292/DIG. 15 |
| 777,408 | 12/1904 | Fletcher | 292/182 |
| 1,036,890 | 8/1912 | Ogden | 292/DIG. 15 |
| 1,587,367 | 6/1926 | Borne | 292/DIG. 15 |
| 1,704,967 | 3/1929 | Fuller | 292/338 |
| 2,774,622 | 12/1956 | Priebe | 292/339 |
| 3,024,056 | 3/1962 | Cook | 292/DIG. 15 |

*Primary Examiner*—Nicholas P. Godici
*Assistant Examiner*—Kurt Rowan
*Attorney, Agent, or Firm*—Thomas R. Vigil

[57] ABSTRACT

The clamp/door stop device comprises an elongate frame including an elongate base with first and second feet each mounted at one end of the base. The feet rest on a planar supporting surface such as a floor. The platform on the base has a planar rest, and a frame portion extends upwardly from the platform and has a planar surface generally perpendicular to the plane of the planar rest. A clamping mechanism for clamping a portion of a door or like object against the planar surface with the object abutting the planar rest are provided. A rod is mounted on the base for sliding movement relative to and transversely of the base in a direction generally parallel to the planar surface and generally 90° to an elongate axis of the elongate frame. A third foot is provided at one end of the rod and is movable with the rod between an extended position and a retracted position. A biasing spring is mounted on the rod at one end of the rod. A latch mechanism for latching the rod in a biased condition where the third foot is located in a retracted position is mounted at the other end of said rod.

13 Claims, 4 Drawing Figures

DOOR STOP/CLAMP DEVICE

BACKGROUND OF THE INVENTION

1. Field of the Invention

The present invention relates to a clamp and door stop device. More particularly, the present invention relates to a device for clamping and supporting a door or window sash while, for example, planing same, or for holding a door while fitting hinges thereto. The device can also be used as a door stop for securing a door in place and has a mechanism whereby it can be released quickly when desired.

2. Description of the Prior Art

Heretofore, various embodiments of door stop devices and clamp devices have been proposed. The device of the present invention differs from the previously proposed devices by providing a combined clamp/door stop device including a quick release door stop mechanism.

SUMMARY OF THE INVENTION

According to the invention there is provided a clamp-/door stop device comprising: an elongate frame including an elongate base portion with first and second feet each mounted at one end of said base portion and capable of resting on a planar surface such as a floor; a platform on said base having a planar rest; a frame portion extending upwardly from said platform and having a planar surface generally perpendicular to the plane of said planar rest; clamping means for clamping a portion of a door or like object against said planar surface with said object abutting said planar rest; a rod mounted on said base portion for sliding movement relative to and transversely of said base portion in a direction generally parallel to said planar surface and generally 90° to an elongate axis of said elongate frame; a third foot located at one end of said rod and movable with said rod between an extended position and a retracted position; means for biasing said one end of said rod away from said frame; and means for latching said rod in a biased condition where said third foot is located in said retracted position.

DESCRIPTION OF THE PREFERRED EMBODIMENT

Figure 1:
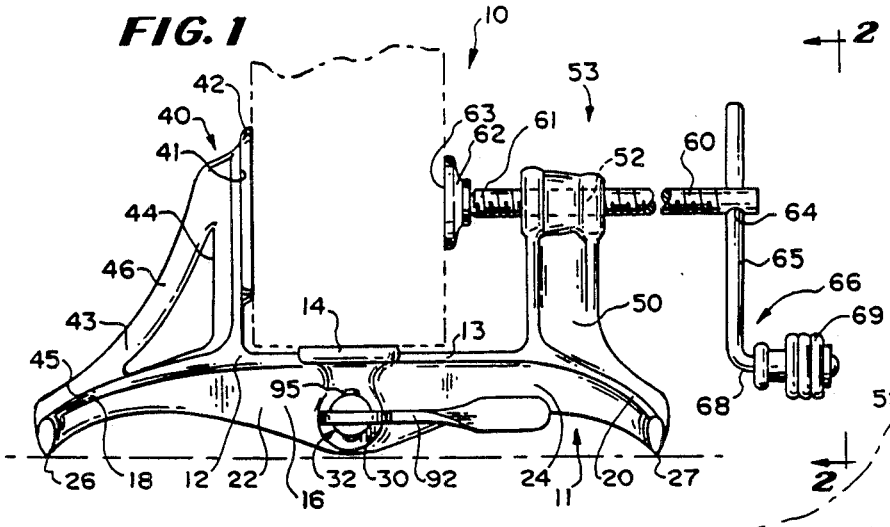
FIG. 1 is a side elevational view of the clamp/door stop device of the present invention and shows the device supported on a floor and in a position clamping a bottom and edge of a planar object.

Referring now to the drawings in greater detail, there is illustrated in FIG. 1, a side view of the clamp/door stop device of the present invention which is generally identified by the reference numeral 10. The device 10 comprises an elongate frame 11 including an elongate base 12. Along the central top portion of the base 12 is situated a planar platform portion 13. As further shown, the platform portion 13 is provided with a stepped, transversely extending rectangular rest 14 which is best illustrated in FIG. 2.

Directly beneath the platform portion 13 in a plane perpendicular to the plane of the platform portion 13, there is provided a strengthening web 16 which extends downwardly from an end 18 to an end 20 of the base portion 12. The web 16 has two wing shaped sections 22 and 24 which extend outwardly from approximately the center of the base portion 12 with the free end of each wing portion tapered in a curvilinear fashion to a pointed or knife edge foot 26 or a pointed or knife edge foot 27 at each end 18 and 20 of the base 12.

At a location central of the web 16 and extending across the web 16 is a generally cylindrical boss 30. Mounted within this boss 30 is a door stop mechanism 32 of the device 10, which will be described in greater detail in connection with the description of FIGS. 3 and 4.

Figure 2:
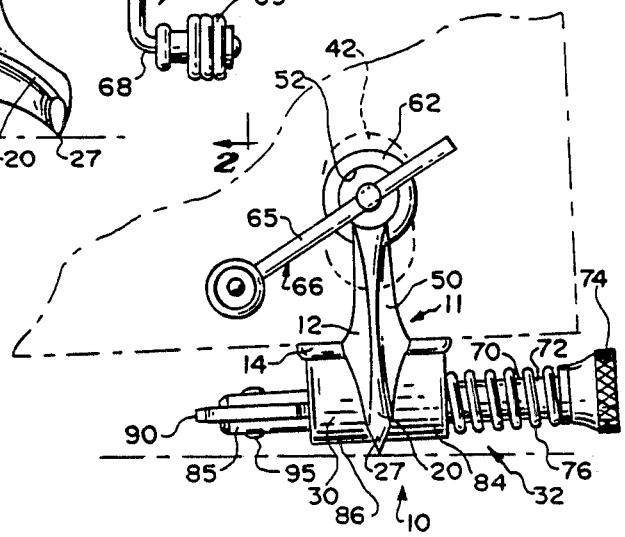
FIG. 2 is an end view of the device shown in FIG. 1, is taken along line 2—2 of FIG. 1, and shows a door stop mechanism of the device in an unlatched extended position.

The boss 30 is also integral with the stepped rest 14 of the platform portion 13 on the top of the base 12, as shown in FIGS. 1 and 2.

Returning now to FIG. 1, the platform portion 13 is approximately one-half the length of the elongate base 12. Extending upwardly from the base 12 and disposed normal to the base 12, at one end of the platform section 13, a short distance away from the rest 14, is a fixed jaw formation 40 having a planar surface 41 generally perpendicular to the plane of the planar rest 14. The jaw formation 40 can be provided with a plastic cushion or pad 42 so as not to mar a piece of wood positioned thereagainst. The fixed jaw formation 40 is provided with a brace 43 comprising a curvilinear member 43 which extends from a position along an upper back surface 44 of the fixed jaw formation 40 to a position along an upper surface 45 of the foot 26 at the end 18, with the curve 46 of the brace 43 facing inwardly downwardly.

At the other end of the platform portion 13 a greater distance away from the rest 14 is a vertically extending arm 50 which terminates in a horizontally disposed cylindrical boss 52 having a threaded bore (not shown). As illustrated, the boss 52 is positioned at a height slightly less than the height to which the fixed jaw formation 40 extends.

Mounted on the boss 52 is a movable jaw formation 53. The movable jaw formation 53 includes a threaded operating screw 60 on one end 61 of which is positioned a swivel or ball joint head 62. This end 61 of the screw 60 extends toward the fixed jaw formation 40 and has a cushioned planar surface 63. The opposite end of the screw 60 has a cross bore 64 extending therethrough which receives a long leg 65 of an L-shaped handle 66. The handle 66 is positioned within the cross bore 64 so that a short leg 68 of the handle 66 extends outwardly away from the screw 60 in a plane radially parallel to that of the screw 60. This leg 68 may, as shown, be provided with a knob 69.

The positioning of the device 10 shown in FIG. 1 illustrates the manner in which the device 10 is positioned for operation as a clamp supported on a floor. In use, one end (shown in phantom) of a door, window jamb, or any other planar object which is to be worked on, is positioned on and against the planar rest 14, being also received between the jaw formations 40 and 53. The handle 65 of the operating screw 60 is turned in a clockwise direction to advance the movable jaw formation 53 until the planar object is firmly grasped between the fixed and movable jaw formations 40 and 53, respectively. With another corner (not shown) of the planar object fixed in place, one can now plane the planar object, attach hinges to the planar object, etc., without having to hold the planar object.

Since the planar object will be positioned at an angle to the floor because of one end being clamped within the device 10, the feet 26 and 27 of the device 10 are pointed or knife edged to allow the device 10 to pivot to an angle where the planar object constantly remains flush against the rest 14 to keep the object from wobbling when it is being worked on.

As shown in FIG. 2, the movable jaw formation 53 is positioned at a height where it will abut against the planar object opposite the pad 42. Also as shown in FIG. 2, the planar object (shown in phantom) is positioned flush against the rest 14 between the jaw formations 40 and 53. If the other end of the object is placed on the floor, the device 10 can pivot on the feet 26 and 27 so that the planar object at all times remains flush against the rest 14.

Figure 3:
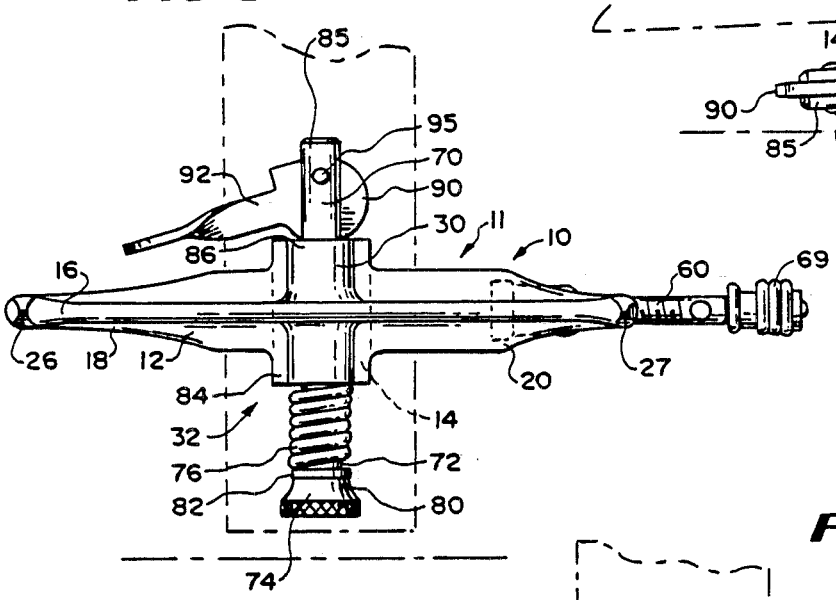
FIG. 3 is a bottom view of the device shown in FIG. 1 and shows the device clamped to the side edge of a door with the door stop mechanism of the device latched in a biased, retracted position.

Referring now to FIG. 3 where the device 10 is mounted to the side edge of a door, the door stop mechanism 32 comprises a spring biased rod 70 which extends through a bore in the boss 30. A lower or bottom end 72 of the rod 70 is provided with a foot 74 which can be attached to the rod 70 by any suitable means. A spring 76 which is utilized to bias the rod 70, as will be described further below, is received around the rod 70 between an upper shoulder 80 or if preferred, a washer 82 positioned on the upper shoulder 80 of the foot 74 and one end 84 of the boss 30. The other end of the rod 70 which exits the other end 86 of the boss 30 is bifurcated (FIG. 2) and received in this bifurcation (FIG. 2) is an eccentric oval cam 90 from which a cam lever arm 92 extends. The cam 90 is attached to the rod 70 by a fastener 95, such as a screw 95, which is inserted into a bore in the rod 70 and through an eccentrically positioned bore (not shown) in oval cam 90.

Figure 4:
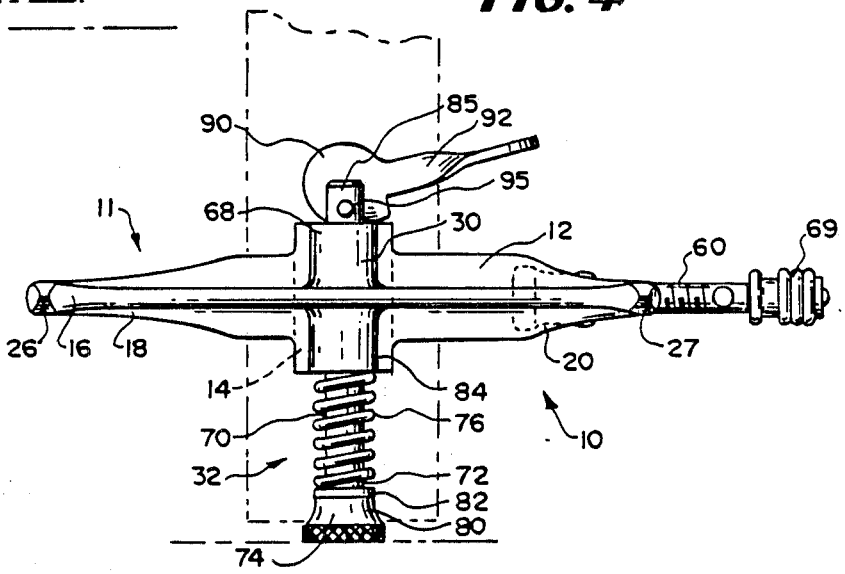
FIG. 4 is a bottom view of the device shown in FIG. 1, and is similar to the view shown in FIG. 3 except that the door stop mechanism of the device is shown in an unlatched, extended position.

With the cam arm lever 92 positioned as shown in FIG. 3, the rod 70 has a greater upward extension than when the lever arm 92 is positioned as illustrated in FIG. 4 due to the eccentric, oval nature of the cam 90.

In FIG. 3, the spring 76 is biased and the cam 90 latches the foot 74 of the door stop mechanism 32 in retracted position.

As shown in FIG. 4 the foot 74 of the door stop mechanism 32 can be extended by rotation of the cam lever arm 92 180° around the fastener 95 to place the lesser extent of the oval cam 90 within the bifurcation (FIG. 2) which releases the spring 76 into a less biased condition with the foot 74 bearing against the floor. In this way, the device 10 provides a quickly engageable and quickly disengageable door stop mechanism 32.

As illustrated in FIGS. 3 and 4, when the device 10 is used as a door stop, a free vertical side edge of a door or like planar object (shown in phantom) is placed flush against the rest 14 and the movable jaw formation 53 is moved inwardly as described above in connection with the description of FIGS. 1 and 2, until the object is grasped within the jaw formations 40 and 53, as best illustrated in FIG. 2.

The vertical positioning of the device 10 along a lower end of the free vertical side edge of the door is done with the foot 74 of the door stop mechanism 32 pointed downwardly and held in its retracted position, as shown in FIG. 3. Typically, the device 10 is positioned so that the foot 74, when in its retracted position, is positioned slightly above the bottom of the door (shown in phantom) and the floor beneath as illustrated in FIG. 3.

Once the device 10 is firmly clamped to the vertical side edge of the door (shown in phantom) and at an appropriate height, one merely flips the cam lever arm 92 over from the position shown in FIG. 3 to the position shown in FIG. 4, approximately 180° to a position on the opposite side of the rod 70 to allow the foot 74 to be extended and urge same against the floor thereby to actuate the door stop mechanism 32.

To release the door (shown in phantom) to a free swing again, with the device 10 still clamped to the door, one would merely flip the lever arm 92 back approximately 180° to the position shown in FIG. 3.

As described above, the clamp/door stop device 10 has a number of advantages, some of which have been described above and others of which are inherent in the invention. For example, the device 10 is approximately 8×4×2 inches in overall dimension and can easily be carried in a conventional toolbox. Further, it is easily applied to and removed from the planar object with which it is to be utilized, and the door stop mechanism 32 is easily activated and deactivated by the flip of the lever 92. Further, the device 10 can be easily and inexpensively manufactured, being basically made of metal, and which can be cast of iron or drop forged.

It is also to be understood that various modifications can be made to the device 10 of the present invention without departing from the teachings of the invention. Accordingly, the scope of the invention is only to be limited as necessitated by the accompanying claims.

We claim:

1. A clamp/door stop device comprising: an elongate frame including an elongate base portion with first and second feet each mounted at one end of said base portion and capable of resting on a planar surface such as a floor; a platform on said base having a planar rest; a frame portion extending upwardly from said platform and having a planar surface generally perpendicular to the plane of said planar rest; clamping means for clamping a portion of a door or like object against said planar surface with said object abutting said planar rest; a rod mounted on said base portion for sliding movement relative to and transversely of said base portion in a direction generally parallel to said planar surface and generally 90° to an elongate axis of said elongate frame; a third foot located at one end of said rod and movable with said rod between an extended position and a retracted position; means for biasing said one end of said rod away from said frame; and means for latching said rod in a biased condition where said third foot is located in said retracted position.

2. The device of claim 1 wherein said clamping means comprise a stationary jaw formation extending upwardly from one end of the base and a movable jaw formation extending upwardly from the other end of the base.

3. The device of claim 2 wherein said jaw formations have cushioned surfaces.

4. The device of claim 2 wherein said movable jaw formation comprises an operating screw received within a screw threaded bore in a boss of an upwardly extending arm of said device and has a ball joint head with a cushioned outer surface at one end thereof and a handle at the other end thereof.

5. The device of claim 1 wherein said rest is an anvil shaped rest disposed transversely of said platform and is slightly elevated therefrom.

6. The device of claim 1 wherein said rod is slidably mounted within a cylindrical boss of said device.

7. The device of claim 6 wherein said biasing means for said rod comprise a spring positioned around said rod between said third foot at the lower end of said rod and a lower end of the boss.

8. The device of claim 6 wherein an upper end of said rod extends from an upper end of said boss and is bifurcated.

9. The device of claim 8 including an eccentric over center cam received within the bifurcated portion of the rod and rotatably fixed therein.

10. The device of claim 9 wherein the eccentric over center cam is provided with a cam lever arm which is adapted to rotate the cam approximately 180° within the bifurcation.

11. The device of claim 10 wherein said cam acts through said rod and boss to apply tension to the biasing spring when it is rotated to a position where the greater area of the cam is within the bifurcation of the rod and bears against said boss.

12. The device of claim 10 wherein said cam and cam lever arm latch said spring in a biased condition.

13. The device of claim 1 wherein said first and second feet are pointed or knife edged to provide a fulcrum about which said device can rotate on a planar surface.

* * * * *